US010991475B2

(12) United States Patent
Likhomanova

(10) Patent No.: US 10,991,475 B2
(45) Date of Patent: Apr. 27, 2021

(54) COMPOSITION FOR DUST SUPPRESSION AND CONTAINMENT OF RADIOACTIVE PRODUCTS OF COMBUSTION

(71) Applicant: STATE ATOMIC ENERGY CORPORATION "ROSATOM" ON BEHALF OF THE RUSSIAN FEDERATION, Moscow (RU)

(72) Inventor: Ol'ga Ivanovna Likhomanova, Moscow (RU)

(73) Assignee: STATE ATOMIC ENERGY CORPORATION "ROSATOM" ON BEHALF OF THE RUSSIAN FEDERATION, Moscow (RU)

( * ) Notice: Subject to any disclaimer, the term of this patent is extended or adjusted under 35 U.S.C. 154(b) by 0 days.

(21) Appl. No.: 16/491,810

(22) PCT Filed: Jan. 29, 2018

(86) PCT No.: PCT/RU2017/000912
§ 371 (c)(1),
(2) Date: Sep. 6, 2019

(87) PCT Pub. No.: WO2018/164601
PCT Pub. Date: Sep. 13, 2018

(65) Prior Publication Data

US 2020/0211726 A1 Jul. 2, 2020

(30) Foreign Application Priority Data

Mar. 6, 2017 (RU) ..... RU2017107488

(51) Int. Cl.
*G21F 9/30* (2006.01)
*G21F 9/00* (2006.01)

(52) U.S. Cl.
CPC ..... *G21F 9/30* (2013.01); *G21F 9/002* (2013.01)

(58) Field of Classification Search
None
See application file for complete search history.

(56) References Cited

U.S. PATENT DOCUMENTS

| | | | | | |
|---|---|---|---|---|---|
| 5,194,174 | A * | 3/1993 | Roe | C09K 3/22 | 252/88.1 |
| 5,536,429 | A * | 7/1996 | Bennett | C09K 3/22 | 252/88.1 |
| 7,658,862 | B2 * | 2/2010 | Talamoni | C09K 3/22 | 252/88.1 |
| 2007/0135561 | A1 * | 6/2007 | Rath | C09K 17/20 | 524/557 |
| 2008/0017829 | A1 * | 1/2008 | Talamoni | C09K 3/22 | 252/88.1 |
| 2008/0255290 | A1 * | 10/2008 | Rath | C09K 3/22 | 524/445 |

FOREIGN PATENT DOCUMENTS

| | | | |
|---|---|---|---|
| EP | 0185393 | A1 | 6/1986 |
| RU | 826872 | A1 | 1/1993 |
| RU | 2194321 | C2 | 12/2002 |
| RU | 2210123 | C2 | 8/2003 |
| RU | 2263984 | C2 | 11/2005 |
| RU | 2274916 | C2 | 4/2006 |
| RU | 2414273 | C2 | 3/2011 |
| RU | 2470068 | C2 | 12/2012 |
| SU | 778557 | A1 | 11/1981 |
| WO | 2005031757 | A1 | 4/2005 |

OTHER PUBLICATIONS

International Search Report of PCT/RU2017/000912 dated May 10, 2018, 4 pages.
Written Opinion of PCT/RU2017/000912 dated May 10, 2018, 3 pages.

* cited by examiner

*Primary Examiner* — Joseph D Anthony
(74) *Attorney, Agent, or Firm* — Brooks Kushman P.C.

(57) ABSTRACT

The invention relates to means for protecting the environment from the consequences of fires complicated by a radiation factor. A composition for dust suppression and containment of radioactive products of combustion after a fire with a radiation factor has been extinguished comprises, as a surfactant, a mixture of an anionic, a non-ionic and an amphoteric surfactant, and has the following ratio of components: 3.0-7.0% by weight of an aqueous solution of polyvinyl alcohol (in terms of a mass fraction of dry product); 0.1-0.3% by weight of plasticizer; 11.0-29.0% by weight of surfactant; with water making up the remainder. The invention makes it possible to carry out dust suppression and containment of radioactive products of combustion which are formed on surfaces, including at elevated temperatures, after a fire has been extinguished.

4 Claims, No Drawings

COMPOSITION FOR DUST SUPPRESSION AND CONTAINMENT OF RADIOACTIVE PRODUCTS OF COMBUSTION

CROSS-REFERENCE TO RELATED APPLICATIONS

This application is the U.S. national phase of PCT Application No. PCT/RU2017/000912 filed Jan. 29, 2018, which claims priority to Russian Patent Application No. RU 2017107488 filed Mar. 6, 2017, the disclosures of which are incorporated in their entirety by reference herein.

BACKGROUND OF THE INVENTION

The invention relates to the means for protecting the environment from radioactive contamination, specifically to dust suppression and polymer compositions for containment based on an aqueous solution of polyvinyl alcohol.

During radiation accidents accompanied by fires, radioactive products of combustion are formed on surfaces and radioactive dust-like contaminants spread from these surfaces to the environment.

A fire-extinguishing agent is known comprising a homogeneous aqueous dispersion of fine carbonate material, which can further contain gel- and foam-forming admixtures. RF Patent No. 2414273, IPC A62D 1/00, Mar. 20, 2011. When applied, a layer of the agent immediately extinguishes a fire, but no polymer containment coating preventing secondary radioactive contamination is formed on the surface.

A method for the containment of surface radioactive contamination is known and is intended for decommissioning nuclear power facilities. During implementation of this method, foam containing 5% polyvinyl alcohol, 1% sodium tripolyphosphate and 1% sulfonol is applied through a foam generator to the surfaces contaminated by radioactive substances and subject to containment. RF Patent No. 2194321, IPC G21F 9/28, G21F 9/34, Dec. 10, 2002. After the natural breakdown of the foam, a uniform containment coating forms on surfaces, significantly reducing the contamination to be removed. One factor militating against use of this foam is the fact that this foam is not designed for application on surfaces covered by smoldering embers and ash, and in these conditions it does not form a continuous coating.

A stabilized foam for decontamination, cleaning and/or degreasing is known, consisting of air bubbles dispersed in a foam-forming aqueous solution containing from 0.1 to 7 moles of one or more decontaminating, cleaning and/or degreasing agents per liter of solution and from 0.01 to 25% of solid particles of the same nature or mixtures of solid particles of different natures depending on the total mass of the solution, and exhibiting foam-forming properties. RF Patent No. 2470068, IPC C11D3/02, C11D3/37, C11D17/00, G21F9/00, Dec. 20, 2012. This foam cannot be used for dust suppression and containment of radioactive products of combustion after the extinguishing of a fire complicated by a radiation factor.

A method is known for preventing the generation and spread of radioactive contaminants during dismantling of buildings upon decommissioning of primarily nuclear facilities, which involves the use of a foam containing a film-forming polyvinyl alcohol in the amount of 7-10% and the foaming agent OP-10 in the amount of 1%, with water making up the remainder. The composition prevents the generation and spread of radioactive contaminants by filling up the inside and outside parts of the structure with the said foam before contaminants can be generated. The foam layer prevents the spread of dust to the environment, as a containment film is formed. RF Patent No. 2263984, IPC G21F 9/28, B08B 15/00, Nov. 10, 2005. This composition is accepted as a prototype.

One drawback of the prototype is its failure to form a continuous coating on the surfaces covered by ash.

SUMMARY OF THE INVENTION

The objective of the present invention and the technical result thereof is the creation of a composition for dust suppression and containment of radioactive products of combustion after the extinguishing of a fire complicated by a radiation factor.

The proposed composition for dust suppression and containment of radioactive products of combustion makes it possible to carry out dust suppression and containment work on hot surfaces at the end of a fire, preventing the spread of dust-like contaminants after embers and ash have cooled. The composition ensures a high degree of foaming and uniform wetting of surfaces by the composition foam. Moreover, particles from the upper layer of ash are absorbed into the bubble walls and start to migrate vigorously under the effect of alternating forces, drawing in more and more ash particles. As a result, a continuous coating is formed on the embers and ash, with the upper layer of the ash being drawn into the coating.

The said technical result is achieved due to the fact that the composition for dust suppression and containment of radioactive products of combustion after the extinguishing of a fire with a radiation factor comprises an aqueous solution of polyvinyl alcohol, a plasticizer and a surfactant; a mixture of an anionic, a non-ionic and an amphoteric surfactant acts as a surfactant, and has the following proportions of components, wt %:

| | |
|---|---|
| an aqueous solution of polyvinyl alcohol (in terms of a mass fraction of dry product) | 3.0-7.0 |
| a plasticizer | 0.1-0.3 |
| a surfactant | 11.0-29.0 |
| water | a remainder |

An aqueous solution of polyvinyl alcohol is used as the film-forming agent.

Glycerine is used as the plasticizer.

The surfactant is a mixture of an anionic, a non-ionic and an amphoteric surfactant in the following proportions, wt %:

| | |
|---|---|
| an anionic surfactant - alkylbenzene sulfonate sulfonol P | 1.0-3.0 |
| a non-ionic surfactant - cocamidopropyl dimethylamine oxide OXI SAA AP.30 | 8.0-22.0 |
| an amphoteric surfactant - cocamidopropyl betaine BETA SAA AP.45 | 2.0-4.0 |

A list of technical documentation for the components of the proposed composition:

1. Polyvinyl alcohol GOST 10779-78;
2. Glycerine GOST 6259-96;
3. Sulfonol P TU 2481-002-40245042-98;
4. OXI SAA AP.30 TU 2482-007-04706205-2006;
5. BETA SAA AP.45 TU 2480-002-04706205-2004.

The proposed composition is produced by mixing the components, the qualitative and quantitative compositions of which are given in Table 1.

EMBODIMENT

An example of preparation of the composition.

The composition is produced by dissolving polymer film-forming polyvinyl alcohol in water (for example, in an electrical boiling pot of KPE-60 trade mark) for 30 minutes at 60-80° C. After cooling, glycerine, sulfonol P, OXI SAA AP.30, and BETA SAA AP.45 are loaded sequentially while the composition is stirred. Stirring continues for 5 minutes after each component is loaded.

The results of tests are given in Table 2.

The composition viscosity was determined in accordance with GOST 9070-75.

The period over which the coating maintains its protective properties was determined according to the procedure MI IRRT-04-2014 of Saint Petersburg State Institute of Technology (Technical University) SPbSIT (TU), developed in accordance with GOST R 51037-97, GOST R 50773-95, GOST 4.54-79, and GOST R 19465-74. The samples contaminated by radionuclides were measured by using the UMF 2000 radiometric unit for recording α- and β-radiation. The composition was applied to the samples contaminated by radiation. After drying, the level of radioactive contamination of the external surface of the coating under test was determined by swabbing at time intervals of 24 hours; 15, 30, 60, 120, and 180 days.

The appearance of the coating on smoldering embers with ash was determined visually on the basis of the presence or absence of a continuous coating.

The diameters of bubbles and their lifespan were determined according to the equipment integrity control method with a sensitivity range of the means of leak detection of $1\cdot10^{-5}$ to $1\cdot10^{-7}$ $m^3Pa/s$ on a diffuse reference leak sample SOP DKT-1 with a gas flow rate of 3 $mm^3/s$, 4 atm.

The time foam breakdown began and ended was determined visually by observing and recording the time of these events.

The foam expansion ratio was determined as the ratio of the foam volume to the composition solution volume, obtained after foam syneresis.

The degree of lump formation was determined according to the procedure MI IRRT-05-2014 of SPbSIT (TU), developed in accordance with GOST R 51037-97, GOST 4.54-79, and GOST R 19465-74. The lump formation level was determined from the following measurements: measurement of the mass fraction of the model dust fraction with a diameter of particles exceeding the critical value after application of the composition on a dust-forming surface. A maximum particle size of 100 μm was taken as the critical value. The mass fraction of the model dust fraction was expressed as a percentage of the total amount of model dust. After application of the composition on a dust-forming surface, the mass of the lump fraction and then the proportion of the lump fraction compared to the initial dry mass were calculated.

Analysis of Results

As Tables 1 and 2, Examples 1-3, show, when the mass fraction of the dry product of the film-forming polyvinyl alcohol is within the range of 3.0-7.0%, the composition covers the embers uniformly and permeates the top layer of the ash, forming a continuous coating. In terms of its scope of use, the coating meets the requirements of GOST R 51037-97—it continues to provide protection for more than 180 days.

When the content of glycerine plasticizer is within the range of 0.1-0.3%, the composition possesses stable foam-forming properties at high values of bubble lifespan, foam expansion ratio and lump formation level.

When the content of SAA sulfonol P is within the range of 1.0-3.0%, the drying composition forms a continuous coating, and it continues to provide protection for the required length of time.

When the content of SAA OXI SAA AP.30 is within the range of 8.0-22.0%, the applied composition does not "sink" into the ash layer, and it possesses stable foam-forming properties and forms a continuous coating.

When the content of SAA BETA SAA AP.45 is within the range of 2.0-4.0%, the composition has stable wetting properties, covers embers uniformly and permeates the top layer of ash.

Examples of use of the compositions with a quantitative composition different from that claimed in the Claims (No. 4-13).

When the weight fraction of the dry product of the film-forming polyvinyl alcohol is less than 3%, a coating is not formed.

When the weight fraction of the dry product of the film-forming polyvinyl alcohol is more than 7%, the foam-forming process is slowed down due to the increased viscosity of the solution, and the coating formed provides protection for an unsatisfactory length of time.

When the content of the glycerine plasticizer is less than 0.1%, the bubble lifespan decreases, which results in fewer ash particles being drawn into the foam and a reduction of the time period, for which the coating provides protection.

When the content of the glycerine plasticizer is more than 0.3%, the foam-forming rate decreases, and the products of combustion permeate in an uneven manner, which results in reduction of the time period, for which the coating provides protection.

When the content of SAA sulfonol P is less than 0.2%, the time period, for which the coating formed by the composition provides protection, is reduced.

When the content of SAA sulfonol P is more than 3.0%, the size of the bubbles increases, which results in voids inside the drying coating, i.e. in a discontinuous coating and a sharp decrease in the time period, for which the coating provides protection.

When the content of SAA OXI SAA AP.30 is less than 8.0%, the time period, for which the coating formed provides protection, is unsatisfactory.

When the content of SAA OXI SAA AP.30 is more than 22.0%, the foam-forming process continues at the same level; there is therefore no reason to consume more material for the reasons of economy.

When the content of SAA BETA SAA AP.45 is less than 2.0%, the time period, for which the coating formed by the composition provides protection, is reduced.

When the content of SAA BETA SAA AP.45 is more than 4.0%, the foam retains the same wetting properties; there is therefore no reason to consume more material for the reasons of economy.

When applied on products of combustion, the prototype composition (Example No. 14) "sinks" into the top layer of ash, failing to uniformly wet the surface and form a uniform coating.

The test results confirm that the proposed composition is designed to meet the objective set and that it complies with all the criteria for registration according to the applicable legislation.

TABLE 1

Qualitative and quantitative (wt %) makeup of the proposed composition

| List of components | Example No. 1 | 2 | 3 | 4 | 5 | 6 | 7 | 8 | 9 | 10 | 11 | 12 | 13 | 14 prototype |
|---|---|---|---|---|---|---|---|---|---|---|---|---|---|---|
| Polyvinyl alcohol | 3.0 | 5.0 | 7.0 | 2.0 | 8.0 | 6.0 | 4.0 | 5.0 | 7.0 | 3.0 | 4.0 | (6.0 | 5.0 | 7.0 |
| Glycerine | 0.1 | 0.2 | 0.3 | 0.1 | 0.3 | 0.05 | 0.4 | 0.3 | 0.1 | 0.2 | 0.2 | 0.3 | 0.1 | — |
| Sulfonol P | 1.0 | 2.0 | 3.0 | 3.0 | 2.0 | 3.0 | 1.0 | 0.5 | 4.0 | 1.0 | 3.0 | 2.0 | 3.0 | OP-71.0 |
| OXI SAA AP.30 | 8.0 | 15.0 | 22.0 | 10.0 | 12.0 | 9.0 | 10.0 | 10.0 | 18.0 | 7.0 | 23.0 | 46.0 | 15.0 | — |
| BETA SAA AP.45 | 2.0 | 3.0 | 4.0 | 2.0 | 3.0 | 4.0 | 2.0 | 3.0 | 4.0 | 2.0 | 4.0 | 1.0 | 5.0 | — |
| water | 85.9 | 74.8 | 63.7 | 82.7 | 74.9 | 77.95 | 82.6 | 81.2 | 66.9 | 86.8 | 65.8 | 74.7 | 71.9 | 92.0 |

TABLE 2

Dust suppression and containment properties of the proposed composition

| | Properties of coatings Characteristics of properties as per Examples No, 1-14 — Example No. 1 | 2 | 3 | 4 | 5 | 6 | 7 |
|---|---|---|---|---|---|---|---|
| Composition viscosity, s | 18 | 17 | 18 | 12 | 30 | 19 | 18 |
| Duration of protective properties, days | >180 | >180 | >180 | 0 | 15 | 60 | 30 |
| Contaminating $^{50}Co$ | >180 | >180 | >180 | 0 | 15 | 60 | 30 |
| radionuclide: $^{90}Sr$—$^{90}Y$ | >180 | >180 | >180 | 0 | 60 | 120 | 60 |
| $^{137}Cs$ | >180 | >180 | >180 | 0 | 15 | 60 | 60 |
| $^{255}Pu$ | | | | | | | |
| Appearance of coating on smoldering embers with ash | Continuous coating | Continuous coating | Continuous coating | Coating is not formed | Continuous coating | Continuous coating | Continuous coating |
| Bubble diameter, mm | 30 | 28 | 32 | 20 | 12 | 20 | 15 |
| Bubble lifespan, min | 50 | 55 | 51 | 10 | 25 | 12 | 30 |
| Time of beginning of breakdown of foam, min | 60 | 50 | 56 | 5 | 15 | 20 | 25 |
| Time of end of breakdown of foam, min | 110 | 100 | 110 | 15 | 60 | 60 | 50 |
| Foam volume, mL | 1,000 | 1,000 | 1,000 | 1,000 | 1,000 | 1,000 | 1,000 |
| Liquid volume, mL | 20 | 18.7 | 19.2 | 50 | 200 | 50 | 25 |
| Foam expansion ratio | 50 | 54 | 52 | 20 | 5 | 20 | 40 |
| Degree of lump formation, % | 82.6 | 84.4 | 82.8 | 0.0 | 38.8 | 45.5 | 39.1 |

| | Properties of coatings Characteristics of properties as per Examples No, 1-14 — Example No. 8 | 9 | 10 | 11 | 12 | 13 | 14 Prototype |
|---|---|---|---|---|---|---|---|
| Composition viscosity, s | 18 | 18 | 17 | 17 | 18 | 17 | 35 |
| Duration of protective properties, days | 120 | <15 | 15 | 60 | 30 | 60 | 0 |
| Contaminating $^{50}Co$ | 60 | <15 | 30 | 120 | 60 | 120 | 0 |
| radionuclide: $^{90}Sr$–$^{90}Y$ | 120 | <15 | 30 | 120 | 60 | 120 | 0 |
| $^{137}Cs$ | 60 | <15 | 10 | 120 | 30 | 60 | 0 |
| $^{255}Pu$ | | | | | | | |
| Appearance of coating on smoldering embers with ash | Continuous coating | Discontinuity of coating | Continuous coating | Continuous coating | Continuous coating | Continuous coating | Coating is not formed |
| Bubble diameter, mm | 10 | 35 | 20 | 30 | 20 | 28 | 5 |
| Bubble lifespan, min | 50 | 30 | 40 | 55 | 40 | 55 | 20 |
| Time of beginning of breakdown of foam, min | 50 | 50 | 45 | 60 | 45 | 50 | 15 |
| Time of end of breakdown of foam, min | 110 | 120 | 90 | 110 | 90 | 100 | 2.5 |
| Foam volume, mL | 1,000 | 1,000 | 1,000 | 1,000 | 1,000 | 1,000 | 1,000 |
| Liquid volume, mL | 25 | 20 | 25 | 20 | 25 | 20 | 25 |

TABLE 2-continued

| Dust suppression and containment properties of the proposed composition | | | | | | | |
|---|---|---|---|---|---|---|---|
| Foam expansion ratio | 40 | 50 | 40 | 50 | 40 | 50 | 40 |
| Degree of lump formation, % | 51.2 | 18.8 | 42.2 | 61.1 | 48.8 | 62.2 | 0.0 |

The invention claimed is:

1. A composition for dust suppression and containment of radioactive products of combustion after the extinguishing of a fire with a radiation factor, comprising÷ an aqueous solution of polyvinyl alcohol, a glycerine and a surfactant, wherein it contains a mixture of an anionic, a non-ionic and an amphoteric surfactant as a surfactant with the following proportions of components, wt %:

| | |
|---|---|
| an aqueous solution of polyvinyl alcohol (in terms of a mass fraction of dry product) | 3.0-7.0 |
| a glycerine | 0.1-0.3 |
| a surfactant | 11.0-29.0 |
| Water | a remainder |

wherein the anionic surfactant is alkylbenzene sulfonate, the non-ionic surfactant is cocamidopropyl dimethylamine oxide, and the amphoteric surfactant is cocamidopropyl betaine.

2. The composition of claim 1, wherein an anionic surfactant alkylbenzene sulfonate is mixed with other substances in the amount of 1.0-3.0 wt %.

3. The composition of claim 1, wherein a non-ionic surfactant cocamidopropyl dimethylamine is mixed with other substances in the amount of 8.0-22.0 wt %.

4. The composition of claim 1, wherein an amphoteric surfactant cocamidopropyl betaine is mixed with other substances in the amount of 2.0-4.0 wt %.

* * * * *